US006135734A

United States Patent [19]

Isozumi et al.

[11] Patent Number: 6,135,734

[45] Date of Patent: Oct. 24, 2000

[54] HIGH-PRESSURE FUEL PUMP UNIT FOR IN-CYLINDER INJECTING TYPE ENGINE

[75] Inventors: Shuzo Isozumi; Wakaki Miyaji, both of Toyko, Japan

[73] Assignee: Mitsubishi Denki Kabushiki Kaisha, Tokyo, Japan

[21] Appl. No.: 09/158,895

[22] Filed: Sep. 23, 1998

[30] Foreign Application Priority Data

Sep. 25, 1997 [JP] Japan ..... 9-260417

[51] Int. Cl.[7] ..... F04B 11/00; F02M 7/00

[52] U.S. Cl. ..... 417/542; 123/447

[58] Field of Search ..... 417/452, 471; 123/446, 447, 467

[56] References Cited

U.S. PATENT DOCUMENTS

| | | | |
|---|---|---|---|
| 4,142,497 | 3/1979 | Long | 123/139 |
| 4,459,959 | 7/1984 | Terada et al. | 123/446 |
| 4,615,320 | 10/1986 | Fehrenbach et al. | 123/467 |
| 4,649,884 | 3/1987 | Tuckey | 123/457 |
| 4,884,545 | 12/1989 | Mathis | 123/447 |

FOREIGN PATENT DOCUMENTS

| | | |
|---|---|---|
| 285 685 | 10/1988 | European Pat. Off. . |
| 400 693 | 12/1990 | European Pat. Off. . |
| 7-12029 | 1/1995 | Japan . |
| 7-83134 | 3/1995 | Japan . |
| 468958 | 8/1937 | United Kingdom . |

*Primary Examiner*—Noah P. Kamen
*Assistant Examiner*—Mahmoud M. Gimie
*Attorney, Agent, or Firm*—Sughrue, Mion, Zinn, Macpeak & Seas, PLLC

[57] ABSTRACT

The high-pressure fuel pump unit for an in-cylinder injecting type engine of the invention comprises high-pressure fuel pump 3 which has a casing 40 having a sucking path and a discharge path, a cylinder 41 provided in the casing 40 and having a sliding hole 41*a*, a fuel pressurizing chamber 45 formed on a part of the sliding hole 41*a*, and a plunger 43 arranged reciprocally movably in the sliding hole 41*a*, sucks the fuel from the sucking path into the fuel pressurizing chamber 45 through reciprocation of the plunger 43, and discharges the pressurized fuel from the discharge path, and pressure-feeds the same to a fuel injector 1 of an in-cylinder injecting type engine; a damper 30 which is provided integrally with the high-pressure fuel pump 3 and absorbs pulsation of the fuel pressure caused by the high-pressure fuel pump 3 in the low-pressure fuel path; and an accumulator 70 which is provided integrally with the high-pressure fuel pump 3 and absorbs pulsation of pressure of the fuel discharged by the high-pressure fuel pump 3.

8 Claims, 5 Drawing Sheets

HIGH-PRESSURE FUEL PUMP UNIT FOR IN-CYLINDER INJECTING TYPE ENGINE

BACKGROUND OF THE INVENTION

1. Field of the Invention

The present invention relates to a high-pressure fuel pump used for an in-cylinder injecting type engine or the like, and more particularly, to a high-pressure fuel pump which permits minimization of the pulsation of the fuel pressure and stabilization of the quantity of injected fuel and the engine revolutions.

2. Description of the Related Art

As an engine of a type of injecting fuel in cylinders of the engine, referred to as the in-cylinder injecting type engine or the direct injecting type engine, there is widely known a diesel engine. An in-cylinder injecting type has recently been proposed even for a spark igniting engine (gasoline engine). In such an in-cylinder injecting type engine, there is a tendency toward increasing the fuel injecting pressure to a sufficiently high level of fuel injecting pressure of, for example, 50 atm. At the same time, the fuel pressure pulsation is required to be small for stabilization of injection. For these purposes, it has been the conventional practice to use a multi-cylinder high-pressure fuel pump having several plungers, such as one disclosed in Japanese Unexamined Patent Publication No. H08-158,974.

In such a multi-cylinder high-pressure fuel pump, however, the complicated structure results in a larger scale and hence in a higher manufacturing cost. Further, it is technically difficult to achieve satisfactory clearance matching applied to minimize fluctuations in accuracy between cylinders, requiring a further increase in the manufacturing cost. A single-cylinder type high-pressure fuel pump is therefore proposed. However, since there is only a single plunger, this type of fuel pump poses a problem of considerable pulsation of pressure of the discharged fuel, and it is necessary to stabilize pulsation at a low cost.

SUMMARY OF THE INVENTION

The present invention was developed to solve the problems as described above, and has an object to provide a high-pressure fuel pump for an in-cylinder injecting type engine reduces the fuel pressure pulsation with a simple configuration and downsizing.

In order to achieve the above object, according to one aspect of the present invention, there is provided a high-pressure fuel pump unit for an in-cylinder injecting type engine comprises a high-pressure fuel pump which has a casing having a sucking path for sucking a fuel and a discharge path for discharging the fuel, a cylinder provided in the casing and having a sliding hole, a fuel pressurizing chamber formed on a part of the sliding hole, and a plunger arranged reciprocally movably in the sliding hole, the high-pressure fuel pump sucking and pressurizing the fuel from the sucking path into the fuel pressurizing chamber through reciprocation of the plunger and discharging the pressurized fuel from the discharge path and pressure-feeding the same to a fuel injector of an in-cylinder injecting type engine; a damper which is provided integrally with the high-pressure fuel pump in the sucking path for absorbing pulsation of the fuel pressure caused in the sucking path by the high-pressure fuel pump; and an accumulator which is provided integrally with the high-pressure fuel pump in the discharge path for absorbing pulsation of pressure of the fuel discharged by the high-pressure fuel pump.

According to another aspect of the present invention, there is provided a high-pressure fuel pump uniform an in-cylinder injecting type engine, wherein at least any one of the damper and the accumulator is secured to the casing by causing a male screw threaded on an outer periphery to engage with a female screw threaded on a recess of the casing.

According to still another aspect of the present invention, there is provided a high-pressure fuel pump unit for an in-cylinder injecting type engine, wherein the damper is of the metal diaphragm type.

According to further aspect of the present invention, there is provided a high-pressure fuel pump unit for an in-cylinder injecting type engine, wherein the accumulator is of the metal diaphragm type.

According to still further aspect of the present invention, there is provided a high-pressure fuel pump unit for an in-cylinder injecting type engine, wherein the damper and/or the accumulator are arranged, on an outer periphery of the casing near the fuel pressurizing chamber, with the main surfaces thereof in parallel with the sliding direction of the plunger.

According to another aspect of the present invention, there is provided a high-pressure fuel pump unit for an in-cylinder injecting type engine, wherein the damper comprises a thick disk-shaped case, a metal diaphragm, and an annular frame, the case having a dent forming the space for deformation of the metal diaphragm, the metal diaphragm and the frame being connected with the case by a single welding so as to cover the dent, a closed space being formed between the case and the metal diaphragm and sealing the air therein.

According to still another aspect of the present invention, there is provided a high-pressure fuel pump unit for an in-cylinder injecting type engine, wherein the deformation starting point of the metal diaphragm is apart from the weld zone by a prescribed distance so as not to be affected by welding.

According to further aspect of the present invention, there is provided a high-pressure fuel pump unit for an in-cylinder injecting type engine, wherein the welding is carried out by laser welding or electron beam welding.

According to still further aspect of the present invention, there is provided a high-pressure fuel pump unit for an in-cylinder injecting type engine, wherein the accumulator comprises a thick disk-shaped case, a metal diaphragm, and a disk-shaped stopper, the case having a dent forming the space for deformation of the metal diaphragm, the metal diaphragm and the stopper being connected with the case by a single welding so as to cover the dent, a closed space being formed between the case and the metal diaphragm and sealing the air therein.

According to another aspect of the present invention, there is provided a high-pressure fuel pump unit for an in-cylinder injecting type engine, wherein the deformation starting point of the metal diaphragm is apart from the weld zone by a prescribed distance so as not to be affected by welding.

According to still another aspect of the present invention, there is provided a high-pressure fuel pump unit for an in-cylinder injecting type engine, wherein the welding is carried out by laser welding or electron beam welding.

DESCRIPTION OF THE PREFERRED EMBODIMENTS

Figure 1:
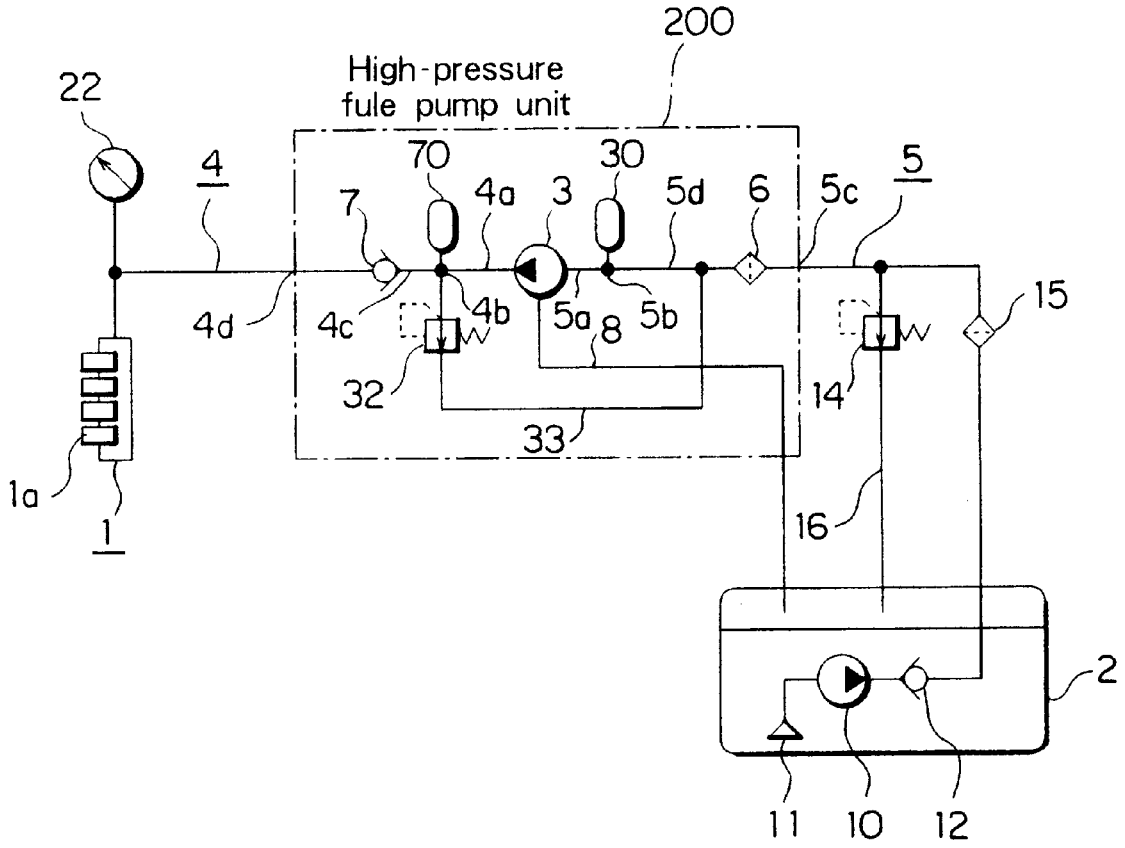
FIG. 1 is a system diagram of a fuel supply system using the high-pressure fuel pump unit of the present invention.
Figure 2:
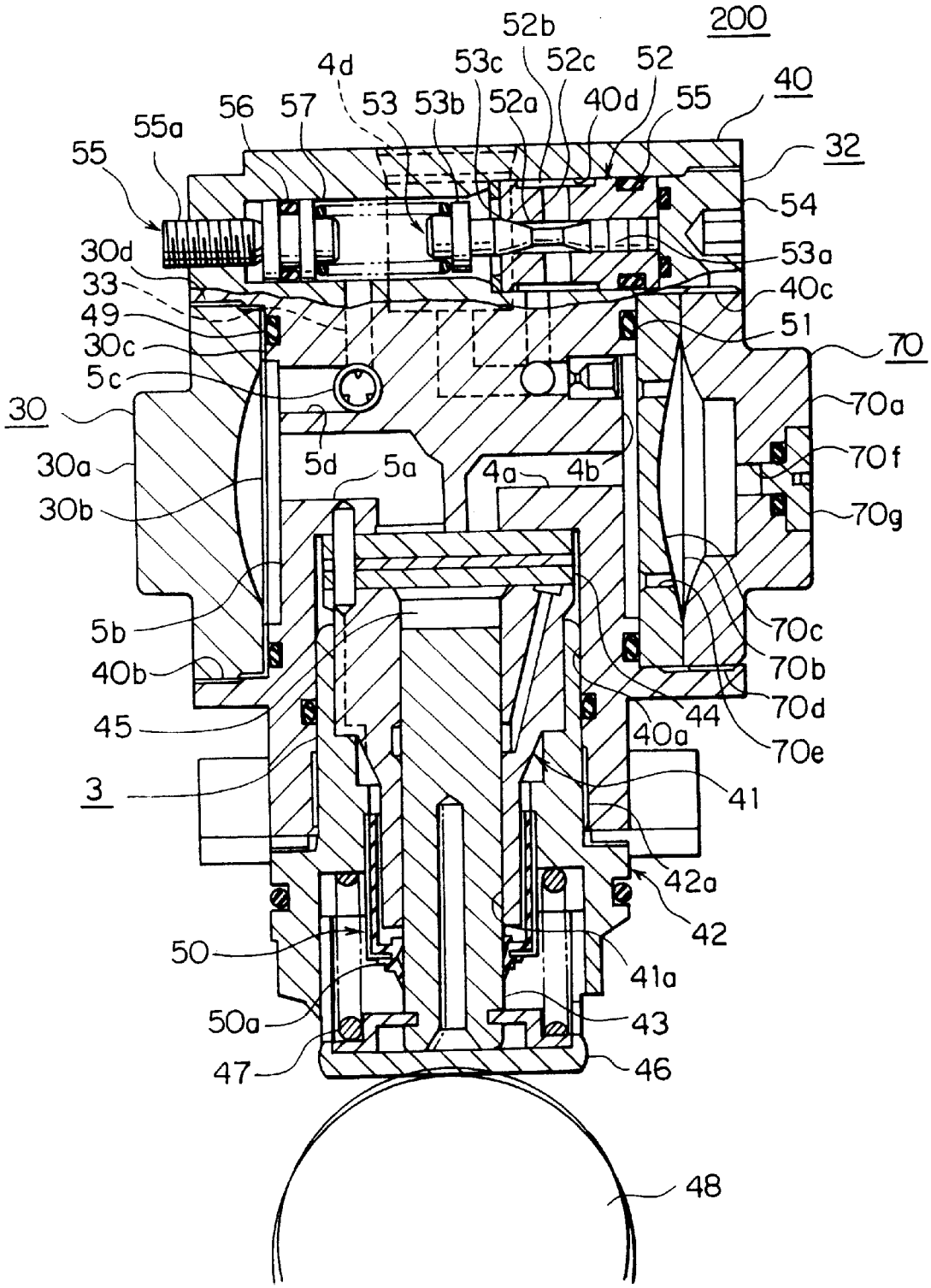
FIG. 2 is a sectional view of the high-pressure fuel pump unit of the invention.
Figure 3:
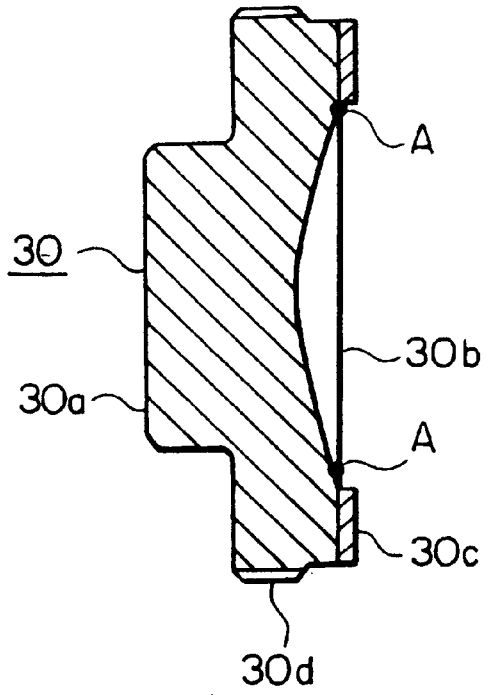
FIG. 3 is a sectional view of a damper.
Figure 4:
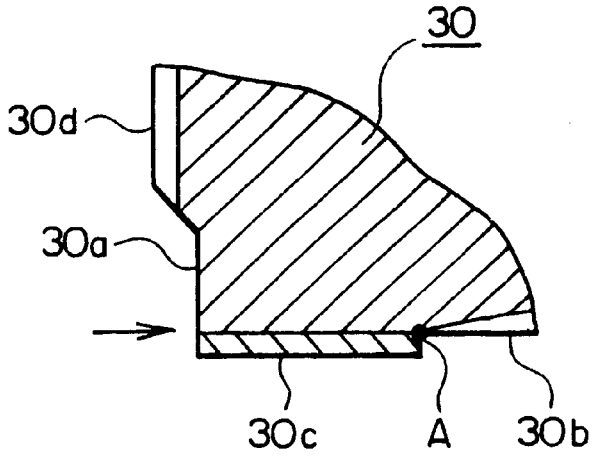
FIG. 4 is a partially cut-away enlarged view illustrating a method for manufacturing a damper.
Figure 5:
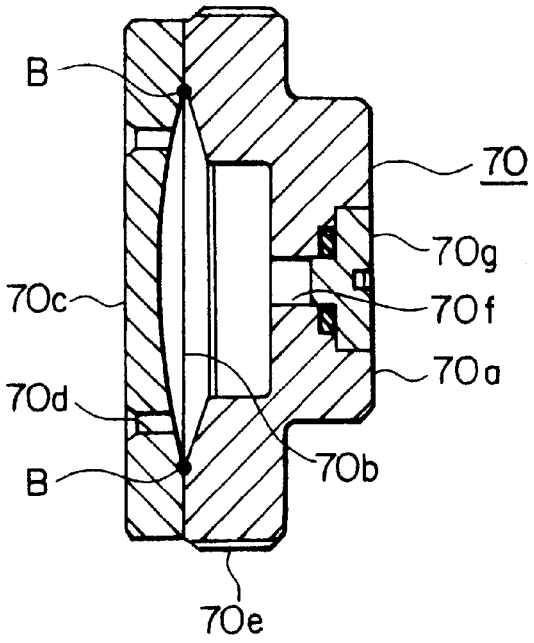
FIG. 5 is a sectional view of an accumulator.
Figure 6:
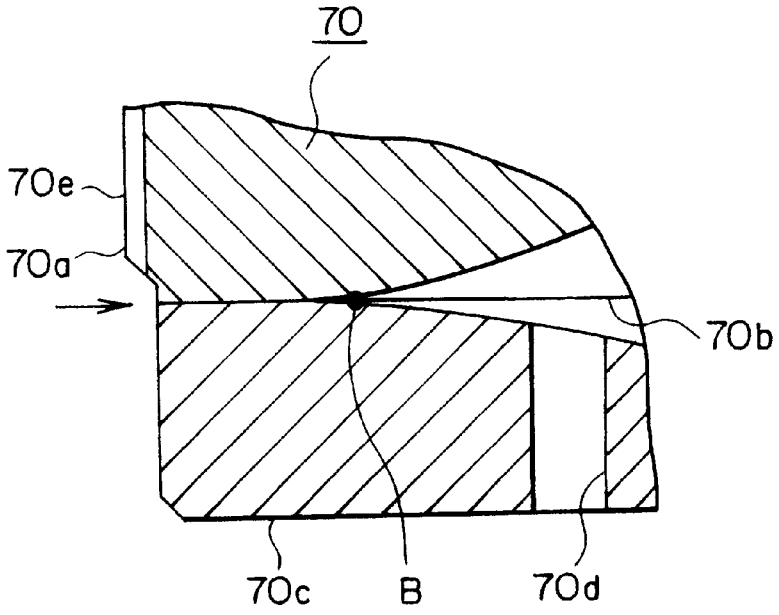
FIG. 6 is a partially cut-away enlarged view illustrating a method for manufacturing an accumulator.

FIG. 1 is a system diagram of a fuel supply system using the high-pressure fuel pump unit of the present invention; FIG. 2 is a sectional view of the high-pressure fuel pump unit of the invention; FIG. 3 is a sectional view of a damper; FIG. 4 is a partially cut-away enlarged view illustrating a method for manufacturing a damper; FIG. 5 is a sectional view of an accumulator; and FIG. 6 is a partially cut-away enlarged view illustrating a method for manufacturing an accumulator.

In FIG. 1, a delivery pipe 1, a fuel injecting device, has a plurality of injectors la in a number corresponding to the number of cylinders of an engine not shown. A high-pressure fuel pump 3 is arranged between the delivery pipe 1 and a fuel tank 2. The delivery pipe 1 and the high-pressure fuel pump 3 are connected by a high-pressure fuel path 4. The high-pressure fuel pump 3 and the fuel tank 2 are connected by a low-pressure fuel path 5. The high-pressure fuel path 4 and the low-pressure fuel path 5 form a fuel path connecting the delivery pipe 1 and the fuel tank 2. A filter 6 is provided at a fuel inlet port of the high-pressure fuel pump 3. A check valve 7 is provided on the discharge side of the high-pressure fuel pump 3. A drain 8 of the high-pressure fuel pump 3 is brought back to the fuel tank 2.

A low-pressure fuel pump 10 is provided at the end of the low-pressure fuel path 5 on the side thereof facing the fuel tank 2. A filter 11 is provided at a fuel inlet port of the low-pressure fuel pump 10. A check valve 12 is provided in the low-pressure fuel path on the discharge side of the low-pressure fuel pump 10. A low-pressure regulator 14 is provided in the low-pressure fuel path 5 between the high-pressure fuel pump 3 and the low-pressure fuel pump 10. A filter 15 is provided at a fuel inlet port of the low-pressure regulator 14. A drain 16 of the low-pressure regulator 14 is brought back to the fuel tank 2.

The high-pressure fuel pump 3 brings the fuel supplied by the low-pressure fuel path 5 further to a higher pressure and discharges it onto the delivery pipe 1 side. A damper 30 is provided on the side of the high-pressure fuel pump 3 facing the low-pressure fuel path 5, i.e., on the low-pressure side. A high-pressure accumulator 31 and a high-pressure regulator 32 are provided on the high-pressure side of the high-pressure fuel pump 3. A drain 33 of the high-pressure regulator 32 is returned to the fuel sucking side of the high-pressure fuel pump 3. The high-pressure fuel pump 3, the damper 30, the high-pressure accumulator 31, the high-pressure regulator 32, the filter 6 and the check valve 7 integrally form a high-pressure fuel pump unit 200.

FIG. 2 is a sectional view of a high-pressure fuel pump unit 200. A cylindrical recess 40*a* is formed below a casing 40. A substantially barrel-shaped cylinder 41 is tightened by a cylinder fixing member 42 in the recess 40*a*. A male screw 42*a* is threaded on the outer periphery of the cylinder fixing member 42 to engage with a female screw on the recess 40*a*. The cylinder 41 has a cylindrical sliding hole 41*a* at the center thereof, and a cylindrical plunger 43 is sliding arranged in this sliding hole 41*a*. A sucking path 5*a* for sucking the fuel and a discharge path 4 for discharging the fuel communicate with the sliding hole 41*a*. A reed valve 44 for opening and closing the sucking path 5*a* and the discharge path 4*a* is held and fixed between a bottom of the recess 40*a* and the cylinder 41. A fuel pressurizing chamber 45 is formed, surrounded by end faces of the reed valve 44 and the plunger 43 in a space above the sliding hole 41*a* in FIG. 2.

A disk-shaped tappet 46 is fixed to the other end of the plunger 43 so that the main surface thereof forms right angles to the plunger 43. A coil-shaped spring 47 is compressed between the tappet 46 and the cylinder fixing member 42. The main surface of the tappet 46 on the side opposite to the plunger 43 is in contact with the cam face of the cam 48. The cam 48 is counted to a crank of an internal combustion engine so as to rotate by a turn for two turns of the crank. The cam 48 rotates along with rotation of the engine, and causes reciprocation of the plunger 43 by overcoming the restoring force of the spring 47.

A substantially cylindrical sealing member 50 is arranged between the plunger 43 and the cylinder fixing member 42. The sealing member 50 is manufactured through insert-forming so that rubber is integral with a cylindrical steel sheet. An end of the sealing member 50 is formed into a double thin-wall shape known as a double ripple shape, and is closely and slidably attached to a side of the plunger 43. The other end of the sealing member 50 is secured to the cylinder fixing member 42. The sealing member 50 provides sealing so that the fuel leaking through the sliding surface formed between the cylinder 41 and the plunger 43 is prevented from leaking to outside. The fuel accumulating in the sealing member 50 is returned to the fuel tank 2 through a drain 8 not shown in FIG. 2.

A recess 40*b* is formed to the left of the casing 40 in FIG. 2. A damper 30 is tightened in this recess 40*b*. A sucking path 5*b* communicating with the sucking path 5*a* is formed in the form of a recess on the bottom of the recess 40*b*. The damper 30 comprises a thick disk-shaped case 30*a*, a metal diaphragm 30*b* made of a thin metal sheet, and an annular plate 30*c* serving as a frame. A gently-sloping dent is formed on a main surface of the case 30*a*. The metal diaphragm 30 is welded together with the case 30*a* by tightly closing so as to cover the dent. More specifically, a closed space is formed between the case 30*a* and the metal diaphragm 30*b* and seals the air therein. A male screw 30*d* is threaded on the outer periphery of the case 30*a*. In the recess 40*b*, on the other hand, a female screw engaging with the male screw 30*d* is formed. The damper 30 is sealed by an O-ring 49 and tightened with the recess 40*b* so as to cover the sucking path 5*b* with the metal diaphragm 30*b* directed inside. The sucking path 5*b* is communicated with a sucking port 5*c* by the sucking path 5*d*. Upon production of a pulsation of pressure in the fuel running through the sucking path 5*a*, the damper 30 causes the metal diaphragm 30*b* to move to the right and the left in FIG. 2 in response to the difference in pressure. It thus absorbs the pulsation in fuel pressure produced in the fuel in the sucking path 5*a* by the high-pressure fuel pump 3.

Now, a method for manufacturing a damper 30 will be described below with reference to FIGS. 3 and 4. In FIG. 3, a dent enclosing the air and serving as a deformed space of the metal diaphragm 30*b* is provided on a main surface of the case 30*a*. The metal diaphragm 30*b* is circular sheet-shaped having a diameter substantially equal to that of the case 30*a*, and is arranged so as to cover the entire dent. An annular sheet-like plate 30*c* is further superposed onto the metal diaphragm 30*b*. A laser is irradiated in an arrow direction as shown in FIG. 4 to integrally connect the case 30*a*, the metal diaphragm 30*b* and the plate 30*c*. Laser welding is carried out over the entire circumference of the damper 30. When the damper 30 is assembled into the high-pressure fuel pump unit 200, the plate 30*c* brings the main surface thereof into contact with the casing 40. The outer periphery of the metal diaphragm 30*b* is held between the case 30*a* and the plate 30*c*, and when deformation occurs under a pressure, the deformation starting point is point A in FIG. 4. Laser welding is applied only to the peripheral edge of the metal diaphragm 30*b*, and welding does not affect this deformation starting point A. Therefore, the deformation starting point A never becomes weaker under the effect of thermal deformation, thus permitting manufacture of a satisfactory damper 30.

To the right of the casing 40, on the other hand, a recess 40*c* is formed. A high-pressure accumulator 70 is secured to this recess 40*c*. A discharge path 4*b* communicating with a discharge path 4*a* is formed as a recess on the bottom of the recess 40*c*. The high-pressure accumulator 70 comprises a substantially disk-shaped thick case 70*a*, a metal diaphragm 70*b* made of a sheet metal and a disk-shaped plate 70*c* serving as a stopper. A gently-sloping dent is formed on a main surface of the case 70*a*. Another gently-sloping dent is formed, on the other hand, on a main surface of the plate 70*c*. The case 70*a* and the plate 70*c* are secured with the metal diaphragm 70*b* in between so that the dents of the both face each other. The case 70*a*, the metal diaphragm 70*b* and the plate 70*c* are welded together over the entire periphery of the opposed surfaces, and are closely connected. A high-pressure gas is sealed in a tightly closed space formed between the metal diaphragm 70*b* and the case 70*a*. One or more communicating holes 70*d* for allowing the fuel to pass through are pierced at prescribed positions in the plate 70*c*. A male screw 70*e* is threaded on the outer periphery of the case 70*a*. A female screw engaging with the male screw 70*e* is formed on the recess 40*c*, on the other hand. An O-ring 51 is located between the accumulator and the casing 40 to seal the fuel discharge path 4*b*.

The high-pressure accumulator 70 absorbs a pulsation of pressure of the fuel discharged onto the discharge path 4*b*. That is, while the fuel is discharged onto the discharge path 4*b*, the metal diaphragm 70*b* moves to the right in FIG. 2 to store a part of the discharged fuel. During the sucking period in which discharging is discontinued, it moves to the left in FIG. 2 to release the stored fuel. As a result, pulsation of pressure of the fuel discharged by the high-pressure fuel pump 3 is reduced.

Now, a method for manufacturing a high-pressure accumulator 70 will be described below with reference to FIGS. 5 and 6. In FIG. 5, a dent enclosing the air and serving as a space for deformation of the metal diaphragm 70*b* is provided on a main surface of the case 70*a*. The metal diaphragm 70*b* is circular sheet-shaped having a diameter substantially equal to that of the case 70*a*, and is arranged so as to cover the entire dent. An annular sheet-like plate 70*c* is further superposed onto the metal diaphragm 70*b*. a deformed space of the metal diaphragm 70*b* is provided also in the plate 70*c*. The plate 70*c* is superposed so that the dent is opposed to the metal diaphragm 70*b*. A laser is irradiated in an arrow direction as shown in FIG. 6 to integrally connect the case 70*a*, the metal diaphragm 70*b* and the plate 70*c*. Laser welding is carried out over the entire circumference of the high-pressure accumulator. The outer periphery of the metal diaphragm 70*b* is held between the case 70*a* and the plate 70*c*, and when deformation occur under a pressure, the deformation starting point is point B in FIG. 6. Laser welding is applied only to the peripheral edge of the metal diaphragm 70*b*, and welding does not effectthe material at the deformation starting point B. Thereafter, a high-pressure gas is injected and sealed through a hole pierced in the back of the case 70*a*. The metal diaphragm 70*b* moves toward the plate 70*c* side by the action of the high-pressure gas when no pressure is applied through the communicating hole 70*d*. The plate 70*c* serves as a stopper when pressure is not applied as described above. When the plate 70*c* is non-existent, the metal diaphragm seriously deforms, resulting in breakage.

A discharge path 4*c* is further communicated with the discharge path 4*b* formed on the bottom of the recess 40*c*. The discharge path 4*c* branches in the middle and the both branch paths extend upward in FIG. 2. On one of the branch paths of the discharge path 4*c*, above the casing 40 in FIG. 2, a high-pressure regulator 32 is arranged. The other of the branch paths communicates with a discharge port 4*d* provided on the outer surface of the casing 40. The high-pressure regulator 32 is arranged in a passage hole 40*d* running through across the casing 40.

The high-pressure regulator 32 has a cylindrical member 52 fixed to a side in the passage hole 40*d* and forming a path in the passage hole 40, and a spool 53 movably arranged in the cylindrical member 52. The cylindrical member 52 is arranged in the passage hole 40*d*, tightened by a fixing member 54 from right in FIG. 2, and has an outer periphery sealed by an O-ring 55. An annular groove 52*b* formed on the outer periphery and a communication hole 52*c* communicating this annular groove 52*b* with a center hole 52*a* are formed in the cylindrical member 52.

The spool 53 takes substantially a bar shape and comprises a shaft section 53*a* housed movably in the cylindrical member 52, and a head section 53*b* formed at an end of the shaft section 53*a* and having a disk-shaped flange 53*b*. A tapered set face 53*c* is formed at a prescribed position of the shaft section 53*a*. A seat 52*d* which can be brought into close contact with this seat face 53*c* and forms a fluid valve together with the seat face 53*c* is formed at an end of the cylindrical member 52.

A spring pressure adjusting screw 55 is arranged on the side of the passage hole 40*d* opposite to the cylindrical member 52. The spring pressure adjusting screw 55 has an outer periphery sealed by an O-ring 56, a screw section 55*a* engaging with a female screw formed on the casing 40, and an end of the screw section 55*a* projecting outside. A spring 57 is compressed between the spring pressure adjusting screw 55 and a head 53*b* of the spool 53. The spring 57 imparts a force in the right direction in FIG. 2 to the spool 53. This imparted force is adjusted by rotating the spring pressure adjusting screw 55.

A drain 33 communicating with the sucking port 5*c* is formed near the position where the spring 57 of the passage hole 40*d* is housed. The high-pressure regulator 32 adjusts pressure of the fuel flowing through the discharge path 4*c*. The fuel having passed from the high-pressure accumulator 70 side through the discharge path 4*c* to the high-pressure regulator 32 passes from the groove 52*b* formed on the outer periphery of the cylindrical member 52 through the communication hole 52*c* and the center hole 52*a* and reaches the fluid valve composed of the seat face 53*c* and the seat 52*d*.

When the fuel pressure is higher than a prescribed pressure, the fuel overcomes the imparted force of the spring 57, causes the spool 53 to move to the left in FIG. 2, and passes through the drain 33 onto the sucking port Sc side. When the fuel pressure is lower than the prescribed pressure, the seat face 53*c* and the seat 52*d* are closed.

Figure 7:
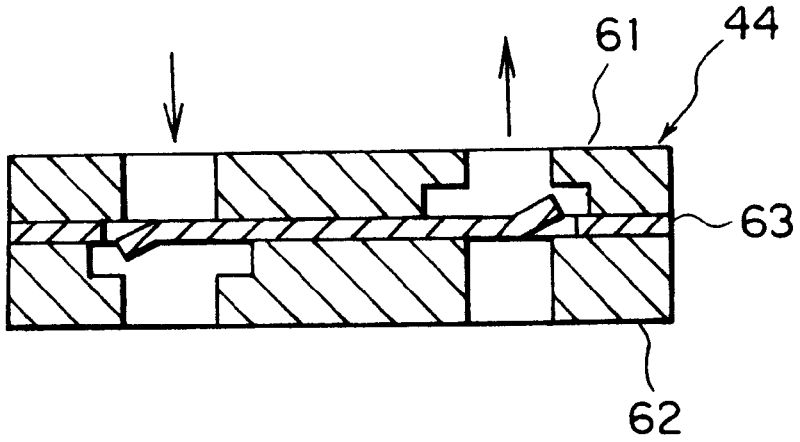
FIG. 7 is a schematic view illustrating the structure of a reed valve.
Figure 8:
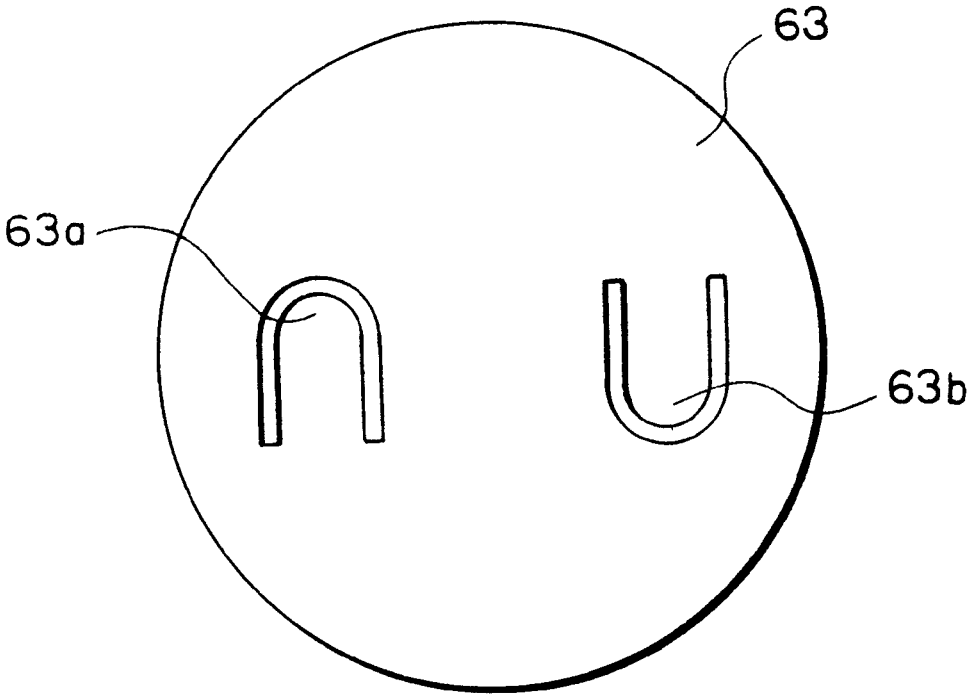
FIG. 8 is a plan view of the valve of the reed valve.

FIG. 7 is a schematic view illustrating the structure of the reed valve 44; and FIG. 8 is a plan view of the valve of the reed valve 44. The reed valve 44 comprises two plates 61 and 62, and a sheet-shaped valve 63 held therebetween. Two throughholes are formed at prescribed positions for allowing the fuel to pass through in the two plates 61 and 62. The two throughholes respectively correspond to the sucking path 5*a* and the discharge path 4*a* formed in the casing 40, and openings on one side thereof are larger to permit a valve body of the valve 63 to operate only in a direction. Two valve bodies 63*a* and 63*b* are formed at positions corresponding to the throughholes of the plates in the valve 63. The reed valve 44 causes the fuel to pass through the fuel pressurizing chamber 45 only in a direction as shown by an arrow in FIG. 7.

The high-pressure fuel pump unit 200 having the configuration as described above sucks low-pressure fuel from the sucking port 5*c*, pressurizes the fuel in the high-pressure fuel pump 3, and discharges the same from the discharge port 4*d*. In other words, the fuel is sucked from the sucking port 5*c*, and enters the fuel pressurizing chamber 45 through the damper 30 section and then the reed valve 44. Then, the fuel is pressurized by reciprocation of the plunger 43 and discharged from the discharge path 4*a*. The fuel having been discharged from the fuel pressurizing chamber 45 passes through the high-pressure accumulator 70 section, and is discharged from the discharge port 4*d* after passing through the high-pressure regulator 32. The fuel discharged from the high-pressure fuel pump unit 200 is directed toward the delivery pipe 1.

Pulsation produced in the fuel sucked from the sucking port 5*c* in this process is absorbed by the damper 30. Pulsation produced by the high-pressure fuel pump 3 in the discharge path 4*a* is absorbed at the high-pressure accumulator 70. Pressure of the discharged fuel is adjusted by the high-pressure regulator 32.

The high-pressure fuel pump unit 200 having the configuration as described above has a damper 30 which is provided so as to be integral with the high-pressure fuel pump 3 and absorbs a pulsation of pressure of the fuel sucked by the high-pressure fuel pump 3, and a high-pressure accumulator which absorbs a pulsation of pressure of the fuel discharged by the high-pressure fuel pump 3. It is consequently possible to effectively eliminate the pulsation with a simple configuration. Since the damper 30 and the high-pressure accumulator 70 are manufactured integrally with the high-pressure fuel pump 3, it suffices to use a single part common to the both components, thus permitting reduction of the number of parts. It is also possible to reduce the number of assembly steps, leading to curtailment of cost. Further, a plurality of installation positions which have conventionally been necessary can be reduced to one, thus permitting reduction of the number of installation positions.

While there have conventionally been available such types of accumulator as the rubber diaphragm type, the bellows type, and the plada type, the damper 30 and the high-pressure accumulator 70 of the present embodiment are of the metal diaphragm type. As a result, the damper 30 and the high-pressure accumulator 70 can be made into a thin shape. It is possible to adopt a simple structure for the damper 30 and the high-pressure accumulator 70, to ensure accurate operations thereof, improve reliability, and reduce cost. Because the metal diaphragms 30*b* and 70*b* never allow transmission of gasoline, there is available a satisfactory damper.

The damper 30 and the high-pressure accumulator 70 are arranged on the outer periphery of the casing 40 near the fuel pressurizing chamber 45, with the main surfaces thereof in parallel with the sliding direction of the plunger 43. More specifically, the thin damper 30 and high-pressure accumulator 70 are tightened to a side of the long high-pressure fuel pump unit 200 in the sliding direction of the plunger 43, with the main surfaces in parallel with each other. This brings about a favorable layout and permits downsizing as a whole. The damper 30 and the accumulator 70 are connected to the casing 40 by causing male screws 30*d* and 70*d* threaded on the outer peripheries to engage with female screws threaded on the recess in the casing 40. As a result, it is not necessary to provide any other tightening parts, thereby permitting connection with a simple configuration. It is therefore possible to reduce the number of parts and cut cost.

The deformation starting points Aand Bfor the metal diaphragms 30*b* and 70*b* are apart by a prescribed distance from the weld zone so as not to be affected by welding. The deformation starting points A and B are therefore free from thermal deformation, deterioration or degradation of strength, thus improving reliability.

The configuration of the present invention is effective particularly for a single-cylinder high-pressure fuel pump. It is however needless to mention that the applicable high-pressure fuel pump is not limited to a single-cylinder one, but the advantages of the invention are available in any high-pressure fuel pump so far as there occurs a large pulsation of pressure of the discharged fuel. The damper 30 and the high-pressure accumulator 70 of this embodiment have been described above as being connected by laser welding, but connection is not limited to laser welding, but, for example, electron beam welding may also be used.

According to one aspect of the present invention, there is provided a high-pressure fuel pump unit for an in-cylinder injecting type engine comprises a high-pressure fuel pump which has a casing having a sucking path for sucking a fuel and a discharge path for discharging the fuel, a cylinder provided in the casing and having a sliding hole, a fuel pressurizing chamber formed on a part of the sliding hole, and a plunger arranged reciprocally movably in the sliding hole, the high-pressurefuel pump sucking and pressurizing the fuel from the sucking path into the fuel pressurizing chamber through reciprocation of the plunger and discharging the pressurized fuel from the discharge path and pressure-feeding the same to a fuel injector of an in-cylinder injecting type engine; a damper which is provided integrally with the high-pressure fuel pump in the sucking path for absorbing pulsation of the fuel pressure caused in the sucking path by the high-pressure fuel pump; and an accumulator which is provided integrally with the high-pressure fuel pump in the discharge path for absorbing pulsation of pressure of the fuel discharged by the high-pressure fuel pump. As a result, a pulsation can be effectively eliminated with a simple configuration. Because of the integral construction, furthermore, it is possible to reduce the number of parts and assembly steps, and to cut cost. It is also possible to reduce the number of installation positions.

According to another aspect of the present invention, there is provided a high-pressure fuel pump unit for an in-cylinder injecting type engine, wherein at least any one of the damper and the accumulator is secured to the casing by causing a male screw threaded on an outer periphery to engage with a female screw threaded on a recess of the casing. It is not consequently necessary to use any other tightening members, and connection is possible with a simple configuration. This permits reduction of the number of parts and hence to cut cost.

According to still another aspect of the present invention, there is provided a high-pressure fuel pump unit for an in-cylinder injecting type engine, wherein the damper is of the metal diaphragm type. As a result, the damper can be prepared into a thin shape. Because of the simple structure and certain operations, it is possible to improve reliability and curtail cost. Since the metal diaphragm never allows permeation of gasoline, there is available a satisfactory damper.

According to further aspect of the present invention, there is provided a high-pressure fuel pump unit for an in-cylinder injecting type engine, wherein the accumulator is of the metal diaphragm type. As a result, the accumulator can be prepared into a thin shape. Because of the simple structure and certain operations, it is possible to improve reliability and curtail cost. Since the metal diaphragm never allows permeation of gasoline, there is available a satisfactory accumulation.

According to still further aspect of the present invention, there is provided a high-pressure fuel pump unit for an in-cylinder injecting type engine, wherein the damper and/or the accumulator are arranged, on an outer periphery of the casing near the fuel pressurizing chamber, with the main surfaces thereof in parallel with the sliding direction of the plunger. This permits achievement of a more compact pump unit as a whole.

According to another aspect of the present invention, there is provided a high-pressure fuel pump unit for an in-cylinder injecting type engine, wherein the damper comprises a thick disk-shaped case, a metal diaphragm, and an annular frame, the case having a dent forming the space for deformation of the metal diaphragm, the metal diaphragm and the frame being connected with the case by a single welding so as to cover the dent, a closed space being formed between the case and the metal diaphragm and sealing the air therein. This permits easy manufacture of a damper with a simple configuration.

According to still another aspect of the present invention, there is provided a high-pressure fuel pump unit for an in-cylinder injecting type engine, wherein the deformation starting point of the metal diaphragm is apart from the weld zone by a prescribed distance so as not to be affected by welding. The diaphragm is therefore free from thermal deformation at the deformation starting point, deterioration or degradation of strength, thus leading to an improved reliability.

According to further aspect of the present invention, there is provided a high-pressure fuel pump unit for an in-cylinder injecting type engine, wherein the welding is carried out by laser welding or electron beam welding. It is therefore possible to certainly weld a tight area, achieve a thin shape, and improve reliability.

According to still further aspect of the present invention, there is provided a high-pressure fuel pump unit for an in-cylinder injecting type engine, wherein the accumulator comprises a thick disk-shaped case, a metal diaphragm, and a disk-shaped stopper, the case having a dentforming the space for deformation of the metal diaphragm, the metal diaphragm and the stopper being connected with the case by a single welding so as to cover the dent, a closed space being formed between the case and the metal diaphragm and sealing the air therein. It is thus possible to easily prepare a damper with a simple configuration.

According to another aspect of the present invention, there is provided a high-pressure fuel pump unit for an in-cylinder injecting type engine, wherein the deformation starting point of the metal diaphragm is apart from the weld zone by a prescribed distance so as not to be affected by welding. The diaphragm is therefore free from thermal deformation at the deformation starting point, deterioration or degradation of strength, thus leading to an improved reliability.

According to still another aspect of the present invention, there is provided a high-pressure fuel pump unit for an in-cylinder injecting type engine, wherein the welding is carried out by laser welding or electron beam welding. It is therefore possible to certainly weld a tight area, achieve a thin shape, and improve reliability.

What is claimed is:

1. A high-pressure fuel pump unit for an in-cylinder injecting type engine, comprising:

a high-pressure fuel pump which has a casing having a sucking path for sucking a fuel and a discharge path for discharging the fuel, a cylinder provided in said casing and having a sliding hole, a fuel pressurizing chamber formed on a part of said sliding hole, and a plunger arranged reciprocally movably in said sliding hole, said high-pressure fuel pump sucking and pressurizing the fuel from said sucking path into said fuel pressurizing chamber through reciprocation of said plunger and discharging the pressurized fuel from said discharge path and pressure-feeding the same to a fuel injector of an in-cylinder injecting type engine;

a damper of the metal diaphragm type which is provided integrally with said high-pressure fuel pump in said sucking path for absorbing pulsation of the fuel pressure caused in said sucking path by said high-pressure fuel pump; and an accumulator of the metal diaphragm type which is provided integrally with said high-pressure fuel pump in said discharge path for absorbing pulsation of pressure of the fuel discharged by said high-pressure fuel pump;

wherein said damper and said accumulator are arranged on an outer periphery of said casing near said fuel pressurizing chamber, with the main surfaces of said damper and said accumulator in parallel with the sliding direction of said plunger.

2. A high-pressure fuel pump unit for an in-cylinder injecting type engine according to claim 1, wherein at least any one of said damper and said accumulator is secured to said casing by causing a male screw threaded on an outer periphery to engage with a female screw threaded on a recess of said casing.

3. A high-pressure fuel pump unit for an in-cylinder injecting type engine according to claim 1, wherein said damper comprises a thick disk-shaped case, a metal diaphragm, and an annular frame, said case having a dent forming the space for deformation of said metal diaphragm, said metal diaphragm and said frame being connected with said case by a single welding so as to cover said dent, a closed space being formed between said case and said metal diaphragm and sealing the air therein.

4. A high-pressure fuel pump unit for an in-cylinder injecting type engine according to claim 3, wherein the deformation starting point of said metal diaphragm is apart from the weld zone by a prescribed distance so as not to be affected by welding.

5. A high-pressure fuel pump unit for an in-cylinder injecting type engine according to claim 3, wherein said welding is carried out by laser welding or electron beam welding.

6. A high-pressure fuel pump unit for an in-cylinder injecting type engine according to claim 1, wherein said accumulator comprises a thick disk-shaped case, a metal diaphragm, and a disk-shaped stopper, said case having a dent forming the space for deformation of said metal diaphragm, said metal diaphragm and said stopper being connected with said case by a single welding so as to cover said dent, a closed space being formed between said case and said metal diaphragm and sealing the air therein.

7. A high-pressure fuel pump unit for an in-cylinder injecting type engine according to claim 6, wherein the deformation starting point of said metal diaphragm is apart from the weld zone by a prescribed distance so as not to be affected by welding.

8. A high-pressure fuel pump unit for an in-cylinder injecting type engine according to claim 6, wherein said welding is carried out by laser welding or electron beam welding.

* * * * *